US009909739B2

(12) United States Patent
Chien

(10) Patent No.: US 9,909,739 B2
(45) Date of Patent: Mar. 6, 2018

(54) LED BULB OR LED NIGHT LIGHT HAVING A MOVING PROJECTION IMAGE

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 14/983,993

(22) Filed: Dec. 30, 2015

(65) Prior Publication Data

US 2016/0215962 A1 Jul. 28, 2016

Related U.S. Application Data

(60) Continuation-in-part of application No. 14/289,968, filed on May 29, 2014, now Pat. No. 9,551,477, (Continued)

(51) Int. Cl.

| | |
|---|---|
| ***F21V 14/08*** | (2006.01) |
| ***F21V 14/06*** | (2006.01) |
| ***F21V 14/02*** | (2006.01) |
| ***F21V 5/04*** | (2006.01) |
| ***F21S 8/00*** | (2006.01) |
| ***F21S 10/02*** | (2006.01) |
| ***F21V 29/00*** | (2015.01) |
| ***F21V 23/04*** | (2006.01) |
| ***F21K 9/232*** | (2016.01) |
| ***F21K 9/60*** | (2016.01) |
| ***F21K 9/65*** | (2016.01) |
| ***F21V 11/08*** | (2006.01) |
| *F21V 23/00* | (2015.01) |
| *F21W 131/30* | (2006.01) |

(Continued)

(52) U.S. Cl.

CPC ..... *F21V 14/08* (2013.01); *F21K 9/232* (2016.08); *F21K 9/60* (2016.08); *F21K 9/65* (2016.08); *F21S 8/035* (2013.01); *F21S 10/02* (2013.01); *F21V 5/04* (2013.01); *F21V 11/08* (2013.01); *F21V 14/02* (2013.01); *F21V 14/06* (2013.01); *F21V 23/0442* (2013.01); *F21V 29/20* (2013.01); *F21K 9/238* (2016.08); *F21V 23/003* (2013.01); *F21V 23/006* (2013.01); *F21W 2131/30* (2013.01); *F21Y 2113/10* (2016.08); *F21Y 2115/10* (2016.08)

(58) Field of Classification Search

CPC ..... F21S 10/007; F21S 10/02; F21S 8/035; F21W 2121/008; F21K 9/232; F21K 9/60; F21V 5/04; F21V 14/02

See application file for complete search history.

(56) References Cited

U.S. PATENT DOCUMENTS 3,762,082 A * 10/1973 Mincy ..... F21S 10/005 362/811
4,779,176 A * 10/1988 Bornhorst ..... G03B 15/02 353/42

(Continued)

*Primary Examiner* — Anabel Ton
(74) *Attorney, Agent, or Firm* — Bacon & Thomas, PLLC

(57) ABSTRACT

An LED light device includes an LED night light or LED bulb having a moving projection image. The movement effect is obtained by (1) causing LEDs to illuminate with a time difference, (2) using a magnetic field force to cause a film, opening, printed piece, or slide to move, shake, spin, rotate, or vibrate, or (3) using a motor or movement to cause the film/opening/printed piece/slide or a projection-lens to move, shake, spin, rotate, or vibrate. Light beams from an LED light source pass through the film/opening/printed piece/slide and then through a projection lens that causes a tiny lighted image to become a bigger or more colorful moving projected image having a wider viewing angle.

20 Claims, 10 Drawing Sheets

Related U.S. Application Data which is a division of application No. 14/280,865, filed on May 19, 2014, now Pat. No. 9,581,299, which is a division of application No. 13/540,728, filed on Jul. 3, 2012, now Pat. No. 8,834,009, application No. 14/983,993, which is a continuation-in-part of application No. 14/503,647, filed on Oct. 1, 2014, now Pat. No. 9,719,654, which is a continuation-in-part of application No. 14/323,318, filed on Jul. 3, 2014.

(51) Int. Cl.

| | |
|---|---|
| *F21Y 113/10* | (2016.01) |
| *F21Y 115/10* | (2016.01) |
| *F21K 9/238* | (2016.01) |

(56) References Cited

U.S. PATENT DOCUMENTS 6,267,478 B1 * 7/2001 Chen ..... F21S 10/007 353/84
6,558,022 B2 * 5/2003 Kawahara ..... F21S 10/007 362/257
7,056,006 B2 * 6/2006 Smith ..... G09F 13/04 362/641
7,748,869 B2 * 7/2010 Sevack ..... F21S 8/02 362/277
7,789,532 B2 * 9/2010 Toriyama ..... G02B 26/007 362/282
7,871,192 B2 * 1/2011 Chien ..... F21S 4/28 362/249.02
8,128,259 B2 * 3/2012 Myers ..... B44C 3/12 362/249.01
8,262,252 B2 * 9/2012 Bergman ..... F21V 5/007 362/232
8,721,160 B2 * 5/2014 Chien ..... F21S 9/02 362/280
8,827,496 B2 * 9/2014 VanderSchuit ..... F21S 10/00 362/184
9,316,838 B2 * 4/2016 Chien ..... G02B 27/08

* cited by examiner 03 optics-lens assembly (fixed)
F
02 stencil, cutoout, opening, film, slide (Rotate)
09 optics-lens assembly (fixed)
08
01
06
A
05
03'
Rotating optic lens-assembly
03"
F
02' stencil, cutouot, opening, print-out, film, slide (fixed)
08'
01'
07
07'
06'
A
05"
05'
PCB
04'
04
AC power source from prong or bulb-base

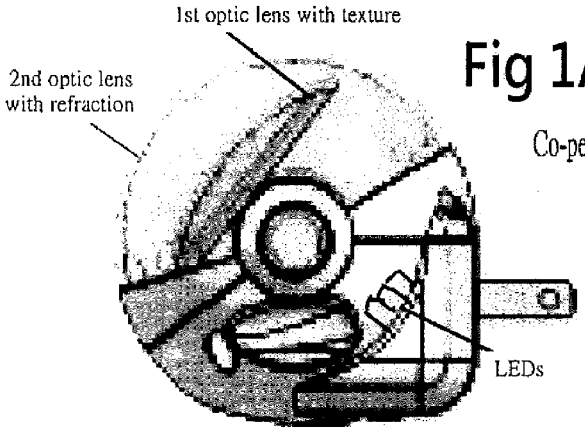

Fig 1A

Co-pending App. Ser. No. 14-503,647 (#ZZZ-3)

Has more than one optic lens including

1. LED +
2. Texture Optic lens as image carrier
3. More than one Refraction or-and reflective lens has almost 160 to 270 degree wide lens.

to create wider viewing angle project image

Fig 1B

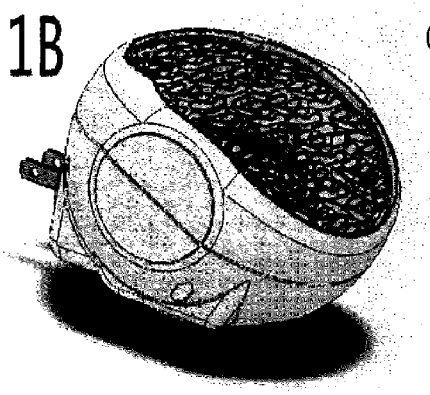

Co-pending App. Ser. No. 14-503,647 (#ZZZ-3)

Has motor/ movement/ spin/ rotate device

1. LED +
2. Image carrier with motor/ movement to moving
3. Multiple optics refraction lens as project-lens has almost 160-270 degree wide lens.

To create wider viewing angle project Image

FIg 1C

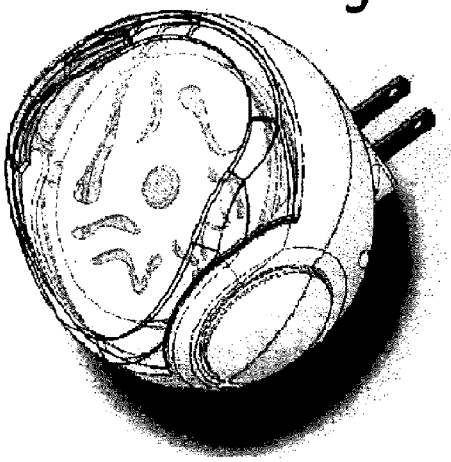

Co-pending App. Ser. No. 14-503,647 (#ZZZ-3)

Has magnetic filed push/pull reaction force to make moving big project-image

1. LED +
2. Moving back-N-forth image carrier film/stencil / openings/ slide/ printed windows
3. refraction or-and reflective lens as project-lens has almost 160-270 degree wide lens.

To create wider viewing angle project Image

Detail of Fig 1 and Fig 1B

Co-Pending Filing
(#ZZZ-3)
US App. Ser. No. 14-503,647

Co-Pending filing
(#ZZZ-3)
US App. Ser. No.
14-503,647

Co-pending filing
US App. Ser. No.
(#ZZZ-1) 14-323,318 &
(#ZZZ-12)14-023,889

Co-pending filing
US App. Ser. No.
(#ZZZ-1) 14-323,318 &
(#ZZZ-12)14-023,889.

Co-pending filing
US App. Ser. No.
(#ZZZ-1) 14-323,318 &
(#ZZZ-12)14-023,889

Fig 5B
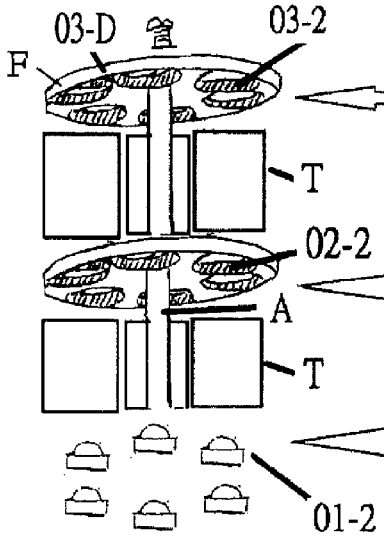
Fig 5A
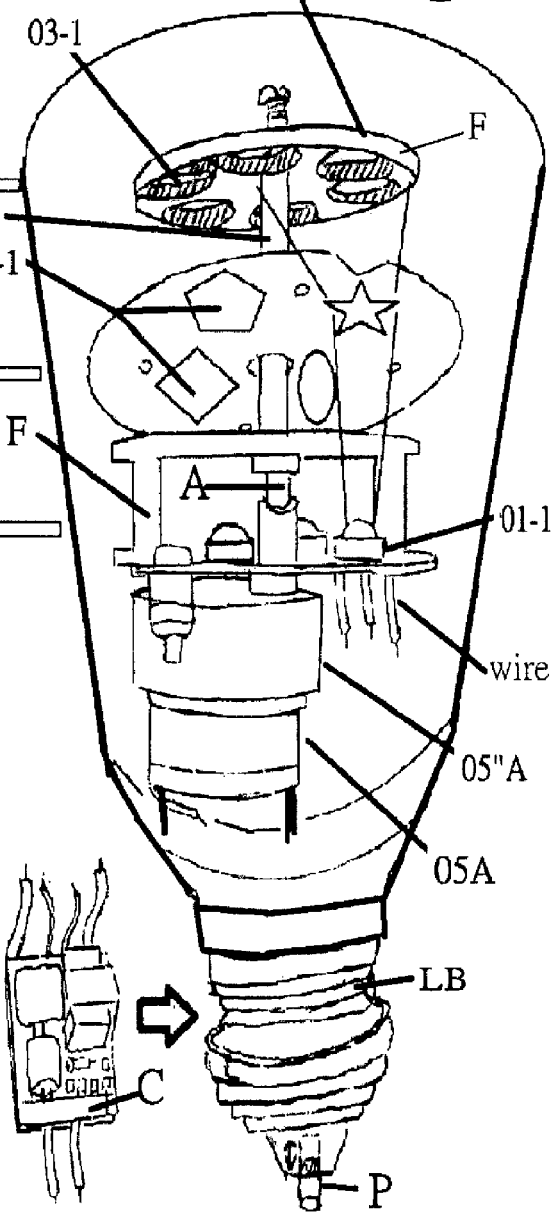
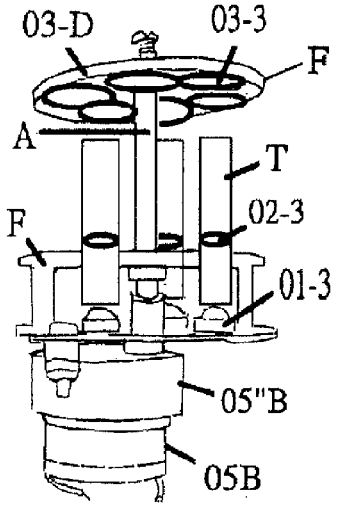
Fig 5C

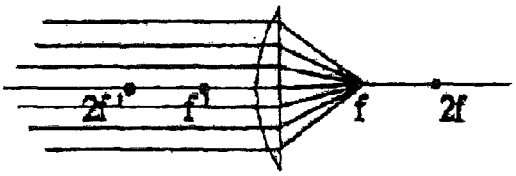

Fig 7

Base Physic theory for Lens focus

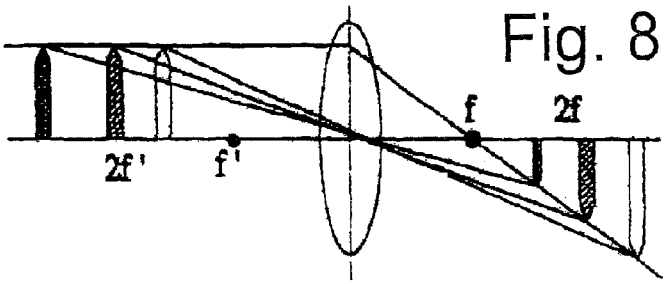

Fig. 8

Basci Physic theory
Relation of object v.s. image v.s. focus of lens.
1.object on 2f ' object has same size of image on 2f .
2.object between f ' and 2f ' –>
image behind 2f with large reverse image .
3. object away from 2f ' –>
the image will fall within 1f and 2f
with smaller and reverse image.

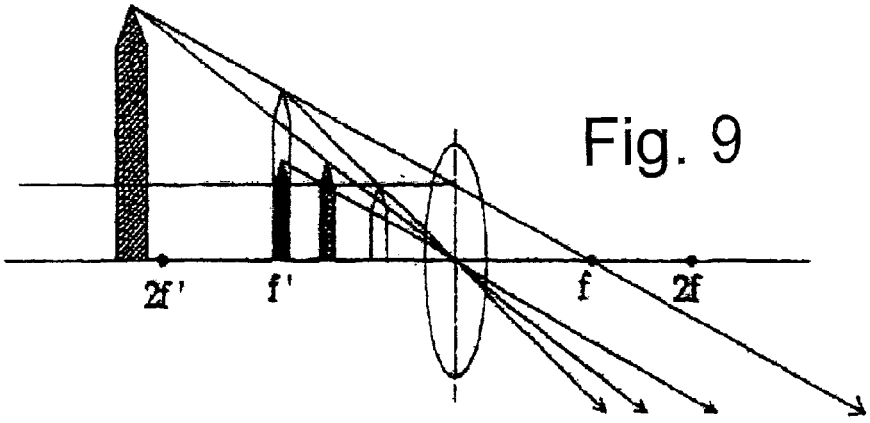

Fig. 9

Object location < f '=>
Image located on the same side of the f' . Image size will become more smaller while the object more close the lens.

LED BULB OR LED NIGHT LIGHT HAVING A MOVING PROJECTION IMAGE

RELATED U.S. APPLICATION DATA

This application is a continuation-in-part of U.S. patent application Ser. No. 14/298,968, filed May 29, 2014, which is a division of U.S. patent application Ser. No. 14/280,865, filed May 19, 2014, which is a continuation of U.S. patent application Ser. No. 13/540,728, filed Jul. 3, 2013, now allowed, which is a continuation-in-part of U.S. patent application Ser. Nos. 13/296,508, 13/296,460, and 13/296,469, each filed Nov. 15, 2011

This application is also a continuation-in-part of U.S. patent application Ser. No. 14/503,647, filed Oct. 1, 2014, which is a continuation-in part of U.S. patent application Ser. No. 14/451,822, filed Aug. 5, 2014, which is a continuation-in-part of U.S. patent application Ser. No. 14/323,318, filed Jul. 3, 2014, which is a continuation-in-part of U.S. patent application Ser. No. 14/023,889, filed Sep. 11, 2013.

This application is also a continuation-in-part of U.S. patent application Ser. No. 14/606,242, filed Jan. 27, 2015, which is a continuation-in-part of Ser. No. 13/367,758, filed Feb. 7, 2012, now U.S. Pat. No. 8,967,831.

This application is also a continuation-in-part of U.S. patent application Ser. No. 14/968,250, filed Feb. 15, 2014, which is continuation-in-part of U.S. patent application Ser. No. 14/539,267, filed Nov. 12, 2014, which is a division of U.S. patent application Ser. No. 12/914,584, filed Oct. 28, 2010, now U.S. Pat. No. 8,721,160, which is a division of U.S. patent application Ser. No. 12/318,470, filed Dec. 30, 2008.

BACKGROUND OF THE INVENTION

The current invention not only includes features disclosed in the parent applications, such as: (1) a projection light, (2) more than one function, (3) adjustable focus, (4) adjustable angle, (5) elastic contact points, (6) an LED heat solution, (7) heat sensitive parts installation, and (8) extend means, but also includes new features such as the inclusion of movable-means to allow at least one level of the more than one lever LED bulb to move away from its original position, location, or orientation to overcome all interfering from light or electromagnetic radiation blocking-means so that the LED bulb can solve (a) heat issues caused by blocking of heat dissipation from the LED(s), circuitry, or electric components, (b) light blocking caused by a lamp shade metal frame's blocking of light emitted by the LED bulb, and/or (c) blocking by glass or metal or cement block means of electromagnetic signals transmitted from Bluetooth means, WiFi means, Internet means, app software means, or any other electromagnetic wave-signals transmitting to control the LED bulb and its related electric parts or accessories. In addition, it is to be appreciated that the above listed or discussed co-pending or issued patents of the inventor may disclose additional features that may be included in the present invention without departing from the current invention's scope.

The current invention thus provides a moving big projection-image light performance to be seen over a wide viewing angle, which can created by (aa) making the LEDs turn on and off at different times to change positions of the light source relative to a film/openings/projection lens, and/or (ab) cause rotation, spinning, vibration, shaking, or moving of a film, openings, slide, printed piece, and/or projection-lens having refractive properties. The LED light source, film/openings/slide/printed piece (image carrier), and/or projection-lens may be fitted into a tube, tube assembly, frame, holder, disc, groove, or ditch of the housing part(s) or separate piece(s__ of, by way of example and not limitation, a night light or LED bulb.

In addition, by way of example, the following U.S. patent applications of the inventor have subject matter in common with the present invention, and the features disclosed therein may be combined with those of the preferred embodiments without departing from the scope of the present invention:

U.S. patent application Ser. Nos. 13/367,758, 13/367,687, 13/296,508, 13/295,301, 13/021,107, 12/950,017, 12/938,564, 12/886,832, 12/876,507, 12/771,003, 13/021,124, 12/624,621, 12/622,000, 12/318,470, 12/914,584, 12/834,435, 12/292,153, 12/907,443, 12/232,505, 11/806,711, and 11/806,285.

This application is also related to U.S. patent application Ser. No. 12/951,501 "Lamp Holder Has Built-In LED Night Light"; Ser. No. 12/950,017 "Multiple Surface LED Light"; Ser. No. 13/162,824 "Light Device With Display Means Has Track-Means and Removable LED-Unit(s)"; Ser. No. 12/938,628 "LED Light Fixture Has Outlet(s) And Removable LED Unit(s)"; and Ser. No. 12/887,700 "Light Fixture With Self-Power Removable LED Unit(s)," as well as the inventor's U.S. Pat. Nos. 7,722,230, and 7,726,869, U.S. patent application Ser. No. 12/073,889, U.S. Pat. Nos. 7,726,841 and 7,726,839, and U.S. patent application Ser. No. 12/894,865.

Still further U.S. patent applications of the inventor that have subject matter in common with the present invention include: U.S. patent application Ser. Nos. 12/624,621, 12/622,100, 12/318,471, 12/318,470, 12/318,473, 12/292,153, 12/232,505, 12/232,035, 12/149,963, 12/149,964, 12/073,095, 12/073,889, 12/007,076, 12/003,691, 12/003,809, 11/806,711, 11/806,285, 11/806,284, 11/566,322, 11/527,628, 11/527,629, 11/498,874, 12/545,992, 12/806,711, 12/806,285, 12/806,284, 12/566,322, 12/527,628, 12/527,629, 12/527,631, 12/502,661, 11/498,881, 11/255,981, 11/184,771, 11/152,063, 11/094,215, 11/092,742, 11/092,741, 11/094,156. 11/094,155. 10/954,189, 10/902,123, 10/883,719, 10/883,747, 10/341,519, 12/545,992, 12/292,580, 12/710,918, 12/624,621, 12/622,000, 12/318,471, 12/318,470, 12/318,473, 12/292,153, 12/710,561, 12/710,918, 12/711,456, 12/771,003

SUMMARY OF THE INVENTION

The current invention provides an LED bulb or night light having at least one movable part to cause at least one image carrier and/or projection-len(s) of the LED night light or LED Bulb to project a big image that exhibits moving effects. The moving effects may also be achieved by causing a plurality of LEDs to turn on and turn off during different time periods and therefore cause the image to change position, location, or orientation to generate moving effects and provide desired light functions, performance, and other effects.

The at least one LED and/or image-carrier and/or projection-lens may be incorporated with a movable-device that includes but is not limited to an IC chip, motor, clock movement, magnet, and/or magnetic coil set, so as to provide moving effects for a big projected image on a desired surface that is at least an arm's length away from the LED night light or LED bulb.

Some of the above-cited parent patent applications of the inventor also disclose moving effects achieved by moving parts. For example, U.S. patent application Ser. Nos. 14/503, 647, 14/451,822, 14/323,318, and 14/023,889 disclose a wide area image or projection image night light with or without motor/spin/rotating kits for moving the image, including use of a motor, timepiece movement, or magnet and magnetic-coil set to cause an image-carrier to shake, vibrate, spin, rotate, or otherwise move in order to provide moving effects that resemble an aurora and water wave effects, as well as use of multiple optics-lenses having reflection and/or refraction properties assembly to provide a splendidly big projection image.

Parent U.S. patent application Ser. Nos. 14/289,968, 14/280,865, 13/540,728 all relate to LED bulbs having projection and/or night light effects. These applications cover all kinds of single or multiple projection bulbs with adjustable focus, projection direction or angle, and which may incorporate projection night light features disclosed in other patent applications of the inventor, such as changeable slides, multiple images, multiple projection heads, or manual or automatically moving slides on a disc. Other concepts disclosed in the inventor's U.S. patent applications. which apply include but are not limited to the concept of fitting an LED, image carrier, and projection lens into the market-available bulb housing with a twist-to-tighten bulb base with electrical contacts.

A preferred embodiment of the current invention f may include a projection night light or LED bulb having built-in multiple projection-assemblies similar to the one disclosed in the inventor's U.S. Pat. No. 8,083,377, FIGS. 15 and 16 of which show a multiple projection head that creates multiple big projected images on areas or a surface. This concept is applied in the current invention to an LED bulb or night light having multiple LEDs, an image carrier, and a projection-lens with a motor, time piece movement, rotate kit, spin kit, movement means, magnet and magnetic-coil set, and/or IC with parts to cause moving effects in the projected images.

The night light of the preferred embodiments may be a plug in night light or desktop night light which has housing parts, a tube, or a tube assembly such as the one shown in FIG. 4 of U.S. Pat. No. 8,083,377, in which are installed image carriers and/or a projection lens, or other parts including but not limited to, an optics lens, motor, gear set, time piece movement with desired rotation speed, a holder, frame, or disc to hold the optics-lens, a projection lens, a tube piece, LEDs, and/or an image carrier or carriers with desired focus and an adjustment mechanism to provide a clear image at different distances.

The LED bulb of the preferred embodiments may also include any number of tubes or tube-assemblies in which LEDs, an image carrier, and/or a projection-lens assembly is installed. The LED bulb can be used for a desk lamp, downwardly facing light, recess light or lamp holder, or an adaptor with preferred power switch or auto sensor switch.

The inventor's U.S. patent application Ser. No. 14/289,968 teaches that an LED bulb can be used for both upwardly facing and downwardly facing or recessed installation because the movable-means including extractable and extendable means can overcome the disadvantage of downward light applications (i.e., applications in which the LED bulb base is on top) that the lamp shade, which may be made of glass, metal, cement, or concrete, will affect or interfere with the transmission of electric signals that enable Bluetooth control, WiFi control, remote control, infrared control, Internet control, or app software control. In addition, the inventor's U.S. patent application Ser. No. 14/289,968 also teaches movable-means that helps to overcome any electric signal blocking means, such as the lamp shade or materials surrounding a recess, and enable the LED bulb to carry out its designed and predetermined functions without being affected by, or interfered with, or limited by the said electric signal block-means.

Still further, the inventor's U.S. patent application Ser. No. 14/289,968 teaches that each level of the more than one level LED bulb can have its own functions, features, or multiple functions/features that are controlled by market available skill or methods selected from Bluetooth, WiFi, Internet, app software, IC, remote signal, infrared signal, motion sensor, or heat sensor control, implemented by a user through a computer, communication device, or other consumer device. The multiple levels of the LED bulb can have: (1) multiple colors with changeable colors and moving effects; (2) multiple functions selected from market available LED light effects for indoor and outdoor lighting; (3) multiple control means selected from a market available control, sensor, switch, Bluetooth, WiFi, Internet, app software, remote, infrared or other electric or electronic related circuit or device; (4) more than one movable-means; (5) changeable geometric shapes; (6) changeable construction; (7) movable means selected from a bar, pole, spinning or rotating mechanism, hinge, arms, joints, or movement-enabling frame, connector, or sections to cause the levels, parts, or accessories to be move to a desired location or position.

Additional features of the invention include the following:

1. The LED bulb has the property that the LED bulb can be twisted over an additional degree or twist angle after the LED Bulb's contact-point touches an electrode in the holder, enabling horizontal positioning over an angle of more than 360 degrees when positioning a light beam to desired area(s) to obtain a wider adjustment angle or wider range of adjustment directions, and with the additional feature of incorporating an adjustable focus means to cause the LED light beams or image to provide different light performances on any desired locations or area(s). The LED bulb may include a rotatable LED Ball with two arms so that an LED bulb of preferable geometric shape and construction may also have a vertical adjustment angle of up to more than 360 degrees so that the LED bulb's plurality of light beams can cover all x-y-z axis areas by at least one of light beam or a plurality of the light beams and illuminate both nearby and faraway or remote areas.

2. The LED Bulb may have one or more than one light source arranged in the LED bulb to provide a desired light performance as described in the inventor's copending U.S. patent applications, which describe a night light with more than one LED light source or LED projection assembly. A difference with respect to the prior arrangements is that a night light has prong means for outlet installation and does not have extendable/retractable means.

3. The current invention includes an LED Bulb with adjustable focus means to enable light beams from the same LED bulb to be emitted to any desired surface(s) with a desired light performance, including a desired brightness, size, light spots, color, or lit-areas. The same light beam output from the same LED bulb with focus adjustable means enables a user to create different light patterns, light paths, light brightness, light performance, and light direction.

4. The LED bulb of the current invention has extendable means, such as an extension tube, telescope tube or equivalent extendable and receivable means that enable the electric parts and accessories of the LED bulb to keep away from the LED's heat, and away from any light blocking-means in the LED bulb, such as a curtain, shade, glass, recess lighting cylinder tube, or other blocking-means that would otherwise block a motion-sensor lens, remote control signal, or light beam emission direction, the extendable means further keeping the LED bulb's circuit board/control means/IC means/switch means/sensor means/electric parts or assembly means away from the LED-units to thereby prevent heat from affecting desired functions or performance, such as the performance of a motion sensor, PIR sensor head, Fresnel lens, or LED-unit light beam emitting direction.

5. The LED bulb of the current invention may have an extractable/extendable/movable means to put heat sensitive or light sensitive parts away from the LEDs' heat, light shade, curtain, glass, decorative material, ceiling blocking means, or any other light blocking means that might interfere with operation of the LED bulb or LED bulb's related parts and accessories. The extendable or extractable means preferably being situated at the front of the LED bulb, although the position will depend on the different requirements and different considerations with respect to heat and light blocking-means, and the ability to offer more space to install the preferred electric parts and accessories, the extra length provided by the extractable/extendable/movable means having the effect of moving sensitive parts far away from the heat source or blocking means so that the LED bulb can overcome the effects of heat and blocking means for any application or installation.

6. The current invention is different from all market-available LED bulbs which offer illumination that only covers an adjacent area starting from the LED Bulb to a certain distance (illumination surrounding the LED bulb) and do not offer illumination or images in areas in certain directions, angles, and distances that are faraway or remote from the LED bulb. The current invention offers any combination of nearby area illumination and faraway area illumination.

7. The current invention provides an LED bulb that may have more than one light beam output to different areas, directions, and locations, including areas that may not be adjacent, linked, or situated together. By offering illumination of more than one area, the invention allows people to save energy by providing illumination exactly where needed. For example, stair lighting only requires up-or-down two-direction illumination. Rest areas do not need light at all, and the stair-lighting may further have a built in motion sensor having sensitivity up to 10-30 feet, which is enough to cover one flight of stairs (normally is 18 steps). Rest areas do not need light at all, and the stair-lighting may further have a built in motion sensor having sensitivity up to 10-30 feet, which is enough to cover one flight of stairs (normally is 18 steps). One light beam from an LED bulb can reach nine steps going up and one light beam from the same LED bulb can reach nine steps going down. This is enough illumination because each UP or DOWN stair are been illuminated by each floor's one LED bulb, with two different of light beams covering nine steps up and nine steps down. This provides pretty a good power saving device while the motion sensor device ensures that only one of the two light beams needs to be output from the LED bulb at any one time.

The current invention can, as noted above, use the principles taught in many other U.S. patent applications of the inventor, including the principle that an LED night light or LED Bulb can have at least one or plurality of light beam outputs with adjustable angles or focus as well as elastic contact-points, a rotating, spinning, or tilting frame, support, or base to provide a desired direction for light beam emission, and/or extendable or retractable means to move parts and accessories away from heat or away from a blocking-means that prevents light beams from being emitted to an area(s) that needs illumination. Furthermore, unlike the conventional LED bulb, which can only illuminate nearby areas over a limited distance, the LED bulb or night light of the present invention can also use an optics lens or lens assembly to project light beams to remote or faraway distances.

BRIEF DESCRIPTION OF THE DRAWINGS

FIGS. 1A, 1B, and 1C show three embodiments of a projection night light having a wider viewing angle and moving projection image. The night light of FIG. 1A uses different on-times of multiple LEDs to change the position or orientation of the light source and thereby provide a motion effect. The night light of FIG. 2A uses a motor or a spinning, rotating, or moving device to cause an image carrier(s) and therefore a projected image(s) to move. The night light of FIG. 3A uses a magnet and magnetic coil with mechanical arms to cause the image carrier to move, shake, or swing and move the big projected image.

FIGS. 5A, 5B, and 5C show a fifth preferred embodiment which can have three main constructions of an LED(s), image carrier(s), and projection-lens assembly with motor/movement means to drive an shaft on top of the motor and which has a plurality of LEDs as a light source, the LED light beams passing through the image-carriers, each of which has one or more than one film, slide, openings, printed windows with or without a fixed or rotating holder or disc. The lighted tiny image from the image carrier is emitted through a top projection-lens assembly which may include one or more than one projection-lens arranged to be moved, rotated, or spun to allow the tiny-image light beam to fall within each projection-lens from one edge to another edge to form a big projection image that moves across a ceiling or walls or floor from an angle N to N−1. The angle depends on how many projection-lenses are inside a round disc, carrier, or holder. For example, six lenses may be arranged on the disc as shown in FIG. 5A, so that each projection-lens covers an angle of about 60 degrees, with the moving big projected image also covering the same 60 degree from appearance to disappearance. In this embodiment, all parts fit within the LED bulb housing without a tube or tube-assembly piece.

FIG. 5B shows an alternative arrangement of a rotating multiple projection-lens assembly which has a round holder to hold or fix six projection-lenses each extending over an angle of around 60 degree or less so that the big projected image will move from appearance to disappearance over a 60 degree angle on a surface. The difference between the LED bulb of this embodiment and that of FIG. 5A is that the light beams from the LED(s) pass through a separate tube(s), so that the light beams from the two sections will not leak too much to inside the housing.

FIGS. 7-9 are schematic diagrams illustrating optics principles utilized by the present invention.

Figures 1, 2:
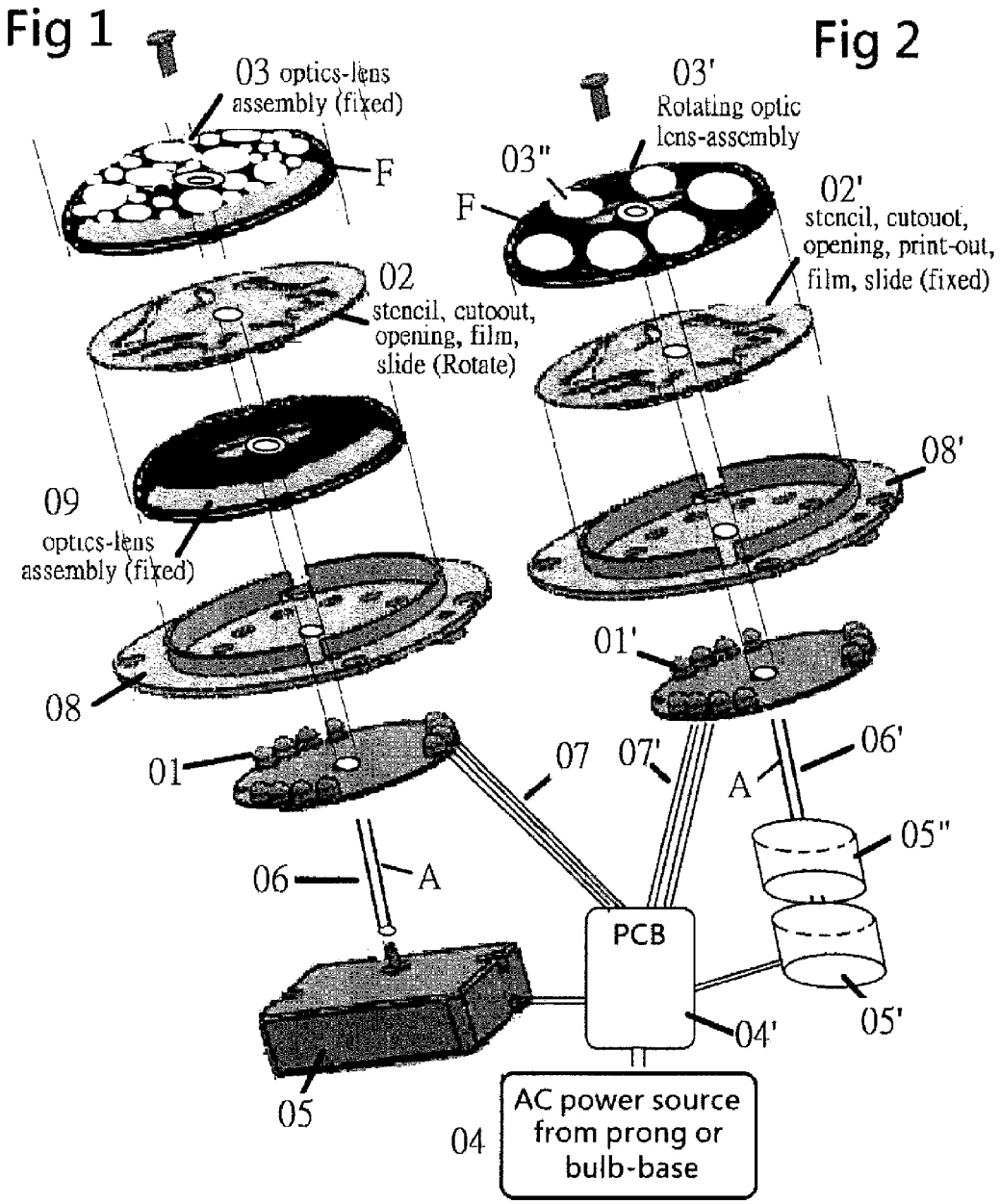
FIGS. 1 and 2 show a first preferred 2 embodiment of an image projecting LED night light or LED bulb having an LED light source(s), image carrier(s), and projection-lens(s) to form a big projection image at a desired location.

The at least some of which differ in that the LED night light or LED bulb has more than one level and includes movable-means that enable at least one level's parts or accessories to any desire location, position and orientation, with each level having one or more than one functions. It is to be appreciated that other concept, feature or equivalent or same function parts/accessories/electric circuit/or concept disclosed in the inventor's other applications may be included in the LED bulbs of the present invention without departing from the scope of the current invention.

DETAILED DESCRIPTION OF THE PREFERRED EMBODIMENTS

As described above, the current invention provides an LED night light or LED Bulb that can present a big projection image that moves within over a predetermined angle from appearance to disappearance and/or present multiple big project images on a surface at the same time.

The current invention offers a big improvement over conventional market-available LED night lights and/or LED bulbs which can only offer nearby area illumination, unlike the current invention which not only has more than one level, parts, and accessories that can change position to overcome (a) heat created by the LED(s), circuitry, and/or electric components, (b) light beam block means that affect or interfere with light emission, (c) signal blocking means that affect or interfere with all kinds of electric signal transmission, or (d) other blocking means that interfere with or affect desired functions, performance, or effects of the LED night light or LED bulb so that one LED night light or LED bulb can offer nearby and faraway illumination, image projection, or both. The night light or LED bulb also can have other features such as (1) changeable colors and moving effects, (2) multiple functions selected from market-available LED light effects for indoor and outdoor lighting, (3) multiple control means selected from a market-available control, sensor, switch, and/or Bluetooth, WiFi, Internet, app software, remote, infrared, or other electric or electronic related circuits or devices, (4) more than one movable-means, (5) changeable geometric shape, (6) changeable construction, and/or (7) moveable means selected from any combination of bar, pole, spinner, rotator, hinge, arms, joint, frame, connector, and sections to cause the levels, parts, and accessories to move away from or to desired locations and positions.

The LED bulb of the current invention, as is also disclosed in other U.S. patent applications of the inventor, may be controlled by more than one control means selected from a power failure detector, remote control, infrared controller, Bluetooth with mobile phone, WiFi, Internet control, app software control, and/or motion sensor to trigger at least one light beam for illumination or image projection to a desired area(s).

The current invention may further utilize additional features and embodiments, also disclosed in other U.S. patent applications of the inventor, including the following:

Feature 1: The LED bulb may consist of at least one LED as a light source that emits light beams to desired areas or locations with predetermined illumination, function, time period, and performance.

The LED bulb may further have parts or accessories that allow for projection and adjustment, including optic means, a lens, an adjustable focus means, twist means, rotate means, an elastic contact end, more than one output light beams, a rotating frame, a bulb shade with arms for enabling rotation, a twist bulb base, support for a shade, an LED assembly, LED tubular means, adjustment means, projection means, digital data display means, LCD display means, digital camera means, data storage means, data projection optics means, sensor means, switch means, IC means, circuit means, extend means, extractable means, filter means, stencil means, cutout means, painting means, motion sensor means, remote control means, blue-tooth means, and Internet wireless means, to enable the LED bulb to emit the light beams, images, time, data, digital messages, and Internet data as desired to nearby areas or remote distance areas for illumination.

The LED bulb connects with a power source by contact means in the base to enable the LED bulb to emit light beams to areas with an adjustable angle coverage, preferably in any direction relative to an x-y-z axis coordinate system, or any combination as required for preferred light performance, effects, and functions.

Furthermore, the direction of at least one of the output light beams from the LED bulb can be adjusted to a certain area, location, distance when adjusting the above-listed component(s) of the LED bulb.

The base of the LED bulb may be in the form of male insert means to fit into the female receiving means for a desired construction.

The said LED Bulb at least has adjustable parts to enable the at least one light beam to change position, direction, or orientation.

Feature 2 The LED bulb as above listed (Feature #1), may be provided with an elastic contact means which allows the LED bulb to adjust the light beam position, location, and direction to certain areas in three dimensions.

Feature 3: The LED bulb as above listed (Feature #1) may include extendable, extractable means to enable parts to be extended away from the LED Bulb and that have a configuration and construction that allows installation of some electric parts and accessories, sensor means, motion sensor means, remote control means, heat sensitive means so as to overcome heat and the blocking effects of a lightshade, lens, curtain, glass, cover, cavity depth, or any other blocking means that might interfere with operation of the LED bulb.

Feature 4: The LED bulb as above listed (Feature #1) can incorporate optics means, an optics lens, or an optics lens assembly with parts and accessories that cause the same light beam to have different light performance.

Feature 5: The LED bulb as above listed (Feature #1), may include a focus adjustment means that enables the same light beam to present different light performances at certain locations, positions, and areas with desire brightness, size, and performance.

Feature 6: The frame and support means of the LED bulb as above listed (Feature #1), may be arranged to enable the bulb to twist, tilt, rotate, spin, and angle-adjust with hold means to overcome any heat issues and facilitate a change in the desired angle.

Feature 7: The base of the LED bulb as above listed (Feature #1), can have any construction including screw type, pin type, poles type, multiple pole type, twist type, and bayonet type construction.

Feature 8: The LED bulb as above listed (Feature #1) may have more than one light beam output so as to emit more than one light beam to locations, areas, and positions that are remote from the LED Bulb.

Feature 9: The LED bulb as above listed (Feature #1) may include an LED tube means that serves to prevent light leakage from the projection means and ensures that LED light beams passing through the optics means, optics lens, display unit, image forming means, LCD display, L cos image, and/or digital display of the projection means can be emitted out of the LED Bulb to desired locations, positions, and areas.

Feature 10: The LED bulb as above listed (Feature #1) may include any of a sensor means, switch means, motion sensor means, remote control means, blue-tooth means, photo sensor means or other market-available electric parts and accessories incorporated with circuit means to cause the LED light source to emit light so as to provide predetermined light functions, performance, and effects.

Feature 11: The extension or retractable means of the LED bulb as above listed (Feature #1) can be installed with select electric parts and accessories, with the LED light source being arranged in the LED bulb in an up, down, or horizontal arrangement.

Feature 12: The LED bulb as above listed (Feature #1) can illuminate any combination of nearby or faraway areas to provide both nearby and faraway area lighting effects.

Feature 13: The LED bulb as above listed (Feature #1) may have more than one function that not only offers illumination for nearby areas or remote distance areas, but that also may incorporate motion sensor, remote control, blue-tooth, and other functions.

Feature 14: The extendable and retractable means of the LED bulb may include any heat-sensitive or light blocking-means-affected circuit means, IC means, electric parts and accessories, switch means, sensor means, remote control means, blue-tooth means or equivalent trigger means, extra LEDs, RF receiving means, IR sensor means, or other control means to overcome the effects of the LED's heat or surrounding blocking-means such as a lighting fixture's shade, cover, glass, frame, support, ceiling, wood piece, metal piece, or plastic pieces. The extend means can extend to a certain distance away from the LED's heat or any blocking-means so that the blocking means will not interfere with delivery of the light beams or electric signal delivery direction that might affect the predetermined functions, performances, and effects of the LED bulb.

Feature 15: The LED bulb may include angle, position, orientation, direction, or focus-adjust means incorporated with optics means, an optics lens, a projection assembly, or an LED assembly. The LED bulb emits the light beam to desire areas in a preferred combination of nearby illumination, faraway illumination, nearby image projection, or faraway image projection, the projection including projection of a digital data image, movie image, internet digital data image, time display, motion picture image, or colorful image.

Feature 16: The LED light beam of the preferred LED bulb may further be triggered by control means which may be selected from one or more of a motion sensor, remote control, infrared sensor, blue-tooth means, power failure means and built-in direct current power storage means, sensor means, switch means, or other electric parts and accessories.

FIG. 1 and show a first preferred 2 embodiment of an image projecting LED night light or LED bulb having an LED light source(s) (01), image carrier(s) (02), and projection-lens(s) or projection lens assembly (03) to form a big projection image at a desired location. Each of the embodiments of the current invention uses the optic theory of FIGS. 7, 8, and 9 applied to the three major parts of an LED light source(s) (01), image carrier(s) (02), and projection-lens(s) or projection-lens assembly (03), which may be at different locations, have different constructions, arranged to fit in a tube or housing parts, incorporated with an IC or desired circuit, have a motor, movement, spin device, or rotating device to cause the three major parts to change position, have a track, groove, or ditch to cause manual or automatic adjustment of the optic-lens to adjust the focus, have moving parts to allow adjustment of the projection image angle, and/or include other features including those disclosed in the inventor's other U.S. patent applications. As shown in FIG. 1 the movement (05), which is super silent device, has an shaft (06 with an extended length and over which is installed LEDs (01) on a base circuit board connected with the PCB (04') that includes electric parts and accessories to control the LEDs to have desired functions including chasing, random, pair flash, sequential, random flash, fade-in and fade-out or any LED light function available from the marketplace. The LEDs are positioned within a top position-board (08) having walls that fit an optic-lens whose main purpose is to widen the viewing angle of the LED's narrow LED light beam so as to cover as wide an area as possible. The light beams are emitted to the image carrier (02) where they are shaped as they pass through the opening(s), printed window(s), cutout(s), films, or slides on the image carrier (02). The shaped or tiny image light beam from the image carrier is emitted to the top projection-lens or projection-lens-assembly (03), which can be a single projection lens (03') or include a plurality of optics-lenses in one assembly (03). The projection-lens or projection-lens-assembly (03) has at least one optic property of refraction to shapes the tiny light beam image into a wider viewing angle image having a desired brightness, color, shape, and/or movement. The big or wider viewing angle projection-image (not shown) appears at a certain distance away from the LED bulb, which connects with a power source at the LED bulb's base through, for example, a retractable contact point that allows people to twist the LED bulb in one more or more circles and attain a desired position or orientation.

e The LEDs (01), circuit board, and top position board (08) with the installed optic-lens (09) do not rotate in this embodiment. Only the image-carrier (02) is moving, rotating, or spinning with the shaft (06) and the speed thereof can be designed as desired. The moving image carrier (02) will allow light beams from the lower LED(s) (01) light beam to pass through the different portions of the image carrier (02), which include the openings, cutouts, film, slide, or printed windows, and be emitted to a top optics-lens-assembly (03), which may have a plurality of optics lenses, to enlarge the viewing angle to between 90 degrees and more than 270 degrees and thereby project a super big size of image on a desired surface such as a ceiling, walls, or floor with moving effects provided by the moving image-carrier. The shaped or tiny-image light beams that pass through the top optic-lens assembly will be refracted in random directions with different shaped light patterns when the image carrier has shaped openings, cutouts, or printed windows but not a film or slide provide aurora effects, with moving effects created by the moving image-carrier.

The LED bulb of FIG. 2 is very similar to that of FIG. 1 but the rotating or moving unit moves the top projection-lens or projection-lens-assembly (03') and not the image carrier (02'). The different arrangement for rotating the projection-lens or projection-lens-assembly (03') rather than the image carrier (2) will cause different light effects. Rotating the projection-lens or projection-lens-assembly (03') will cause the shaped or tiny-image emitted from the image-carrier to pass through the top of each single optic-lens of the multiple optic-lens assembly so as to cause one image to move to different locations and look like a continuously moving image, For example, a six optics-lens assembly can provide an approximately 60 degree moving image. Further details of the movement are described in connection with FIG. 6. Similarly to the LED bulb of FIG. 1, the LED bulb of FIG. 2 has three major components made up LEDs (01'), an image-carrier (02'), and a project-lens-assembly (03') that all fit below a motor (05') and motor gear set (05"). The motor has very fast rotation speed (RPM) so that a motor gear set (05") is needed to reduce the speed to a preferred RPM so people will not see too quickly rotating or moving projection-images and feel bad. The LEDs (01') fit on the circuit board, and the LED light beams are emitted through the optional position board (08') or other design frame (F), support (S), holder (H) or other optics-lens holder to cause the narrow LED light beams to become wider and pass though the top of the position board (08'), which may support an image carrier (02') that is the same as the one shown in FIG. 1 with shaped openings, cutouts, stencils, film, slides, and/or a display-unit to allow the LEDs' light beams to pass to through a respective moving single project-lens (03") to form the image. Because each single project-lens (03") is rotating, the shaped or tiny-image light beam will go through each single optics-lens (03") one by one to form a continuously moving big image with different timing and angles on a surface.

If the shaped or tiny-image light beam has a sufficiently wide angle, it can pass through multiple single optic-lenses (03") at the same time and, because the optics-lens is rotating, the image will appear to continuously move from one circle side to the other circle side. The moving direction can be clockwise or anti-clockwise, depending on the motor or spin device rotation direction. The number of the shapes, openings, cutouts, printed windows, film, slide, or display-unit and the corresponding LED number will determine the number of big projected-images.

Figure 6:
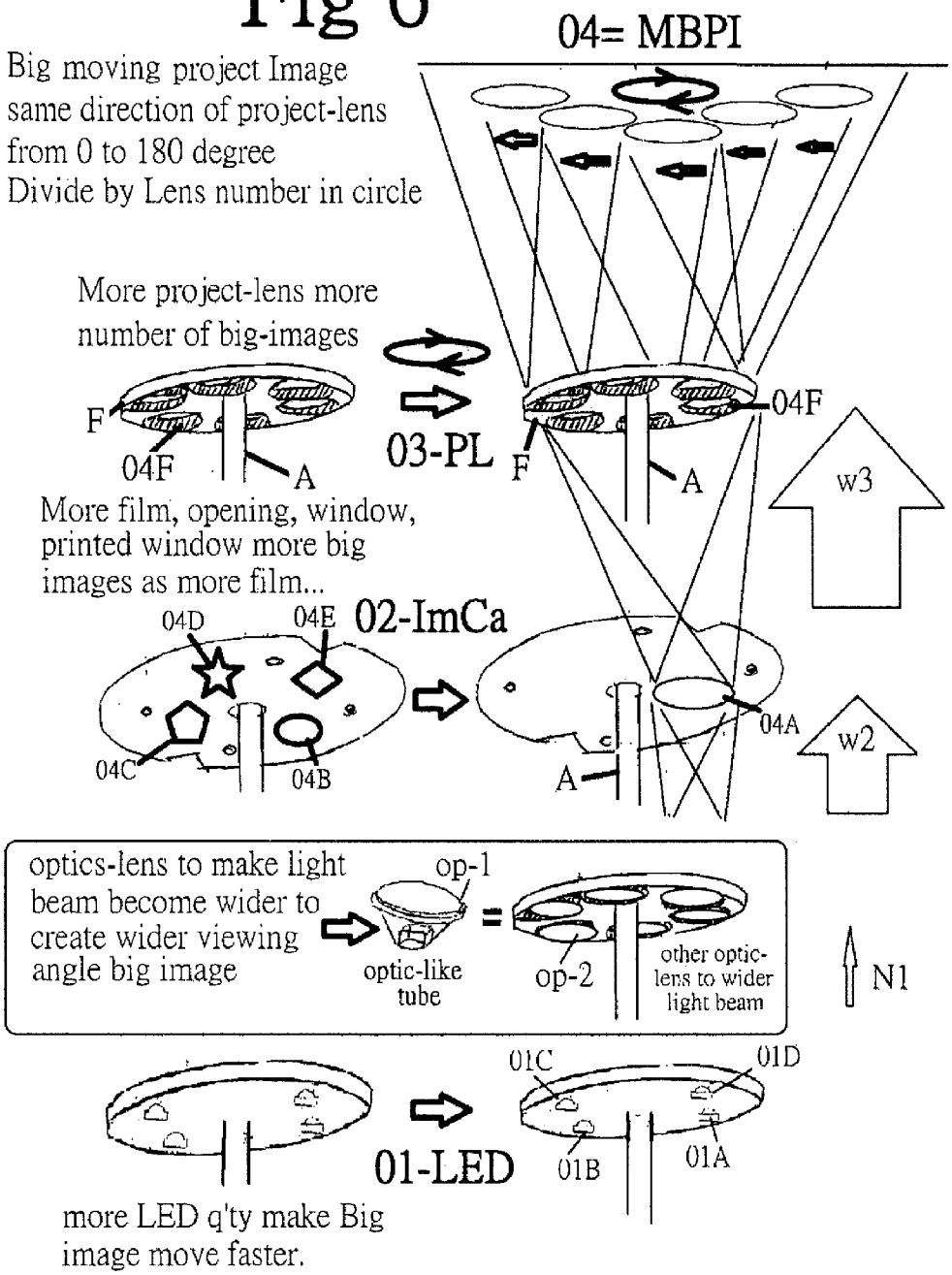
FIG. 6 illustrates the light theory of a projection assembly with than one projection head, such as the built-in multiple projection-assembly shown in the inventor's U.S. Pat. No. 8,083,377. The current invention has a plurality of the LEDs above which is an image-carrier in one piece or which has many different films, slides, openings, printed windows, or stencils to allow the LED light beams to pass through and form a lighted tiny-image to go through any number N of top projection-lenses in a disc or holder so that a moving big projected image moves over an angle N from appearance to disappearance.

More details of the moving projection-lens or projection-lens-assembly (03) are shown in FIG. 6.

FIG. 1A shows an alternative way to create a wider viewing angle projection-image on a surface. This embodiment uses more than one optic-lens having at least one refractive lens to cause a narrow LED light beam that passes through the first lens to become multiple refracted light beams and the multiple refracted light beams pass through the outside second lens to create even wider viewing angle projection-images. The first lens may also have texture which can be a wave type and the LEDs can be more than one of blue-light, green-light and white-light LEDs with an IC controller to cause the LEDs to change color during a desired time period with desired functions, speed, and brightness selected but not limited to fade-in and fade-out, chasing, pair-flashing, random, automatically changing function, freeze function, sequential or other market-available LED light functions.

As shown in FIG. 1A, the blue, green, and white color three LED light beams are emitted to the wave texture optical lens. All the LED light beams go through the wave texture refraction optic lens and come out as many light beams that pass through the second lens then can come out as a lot of wave-shaped blue, green, and white projection images. While the blue, green, and white LEDs are turned on and off during different time periods with preferred fade-in and fade-out sequences, the LEDs arranged 1->2->3 front and back to create the moving water wave effects so that a non-motor device.

Figure 1D:
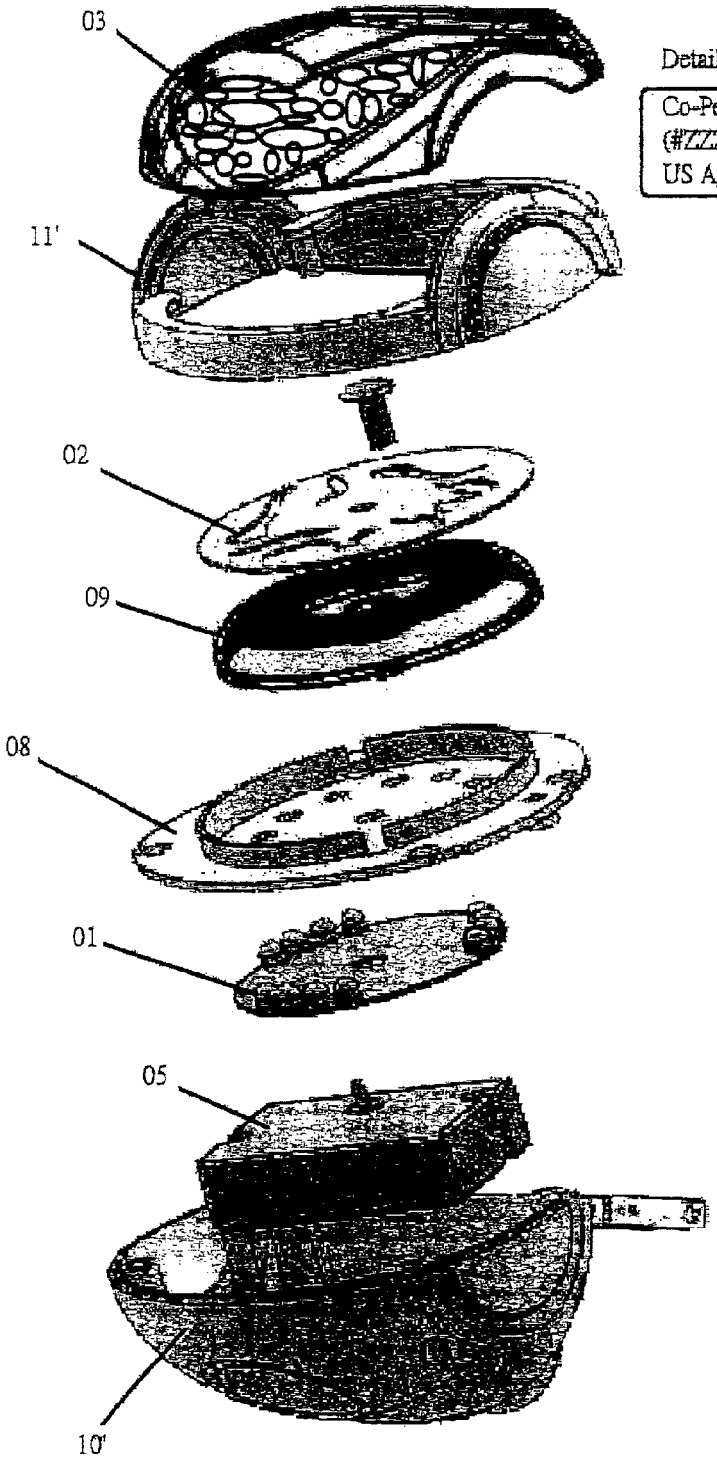
FIG. 1D shows a detailed construction of the night light of FIG. 1B, which has a movement or motor at the bottom and an shaft long enough to hold and rotate the image carrier and also allow for LEDs and a circuit board to be positioned along an axis of the night light such that light beams pass through a top optic-lens to change a narrow LED light beam into a wider and parallel light beam after having passed through the image-carrier's opening, cutout, windows, printed window, film, slide, display, or digital data display, the top projection-lens being any type of refraction-lens, multiple refraction-lens, refraction plus reflection lens, or any combination of lenses to create desired light effects.

FIG. 1B shows the outside shape and FIG. 1D shows the detailed construction of how to make a moving projection-image similar to the aurora of FIG. 1. The LED bulb wide angle, approximately 180 degree, upper projection-lens formed by a plurality of small optic-lenses. Each small optic-lens has its own focus, thickness, and curvature to create different reflective or refractive light effects. The inner construction is as discussed above in connection with FIG. 1, including three main components, namely the LEDs, image-carrier, and projection-lens-assembly as discussed above. Each of the embodiments shown in FIGS. 1A, 1B, 1C, 1D, and 1E may have prongs to form a wide viewing angle projection night light while the same construction of the major three components can also fit into a bulb shaped housing with a bulb-base to provide a moving projection-image LED bulb. The power source comes from a wall outlet or from the bulb-base power source, depending on whether a conductive prong or conductive bulb base is provided. Thus, each of the embodiments of the current invention can be arranged as an LED plug-in night light or an LED bulb with a conductive bulb base. The housing can have any geometric shape.

FIGS. 1C and 1D show an outside shape and detailed construction of the alternative way to get the moving projection-image for an LED night light or LED bulb. The three major components LEDs (01"), image-carrier (02"), and projection-lens assembly (03") are the same as disclosed in the inventor's U.S. patent application Ser. No. 14/503,617, and are arranged to form a big viewing angle projection-image that is move by electromagnetic force to cause vibration, shaking, swinging, or waving of moving part (02B), arm (02B), pole (02B), craft (02B), axis (02B), or bar (02B), which are connected with magnetic unit (02A) Magnetic unit (02A) is affected by or reacts to the magnetic-coil device (02E) when different currents pass through the magnetic-coil (02E) to create a magnetic field and force that pulls or pushes the magnetic-unit (02A). As a result, the magnetic-unit will cause the attached, connected, or joined-together moving part (02B), arms (02B), pole (02B), craft (02B), axis (02B), and/or bar (02B) to wave, shake, swing, or move and cause the first optic lens or image-carrier (02") having texture or without texture to change position and provide the desired light effects. The moving parts (02B) are attached to the first optic-lens or image carrier (02") at two sides of pole (02C) so that when the moving parts (02B) move, the two sides of the pole (02C) sit on the two sides of frame (02D), which will also change position so cause the first optic-lens or image-carrier (02") to move and emit different light beams to the top projection-lens and form a big viewing angle projected image on a desired floor, ceiling or walls, but not the wall that has the power outlet or surface that receives the bulb base.

FIGS. 3, 3A, 3B, 3C, 3D, 3E, and FIG. 3F various preferred LED bulb designs and shapes, which are also disclosed in other U.S. patent applications of the inventor. The bulbs may have a desired moving optics-lens, moving image-carrier, different LED turn on and turn off times, a magnetic reaction force device, a single projection tube device, multiple single project tube devices, or a projection assembly inside the housing to project a wide viewing angle moving projection-image on a surface.

Figure 4:
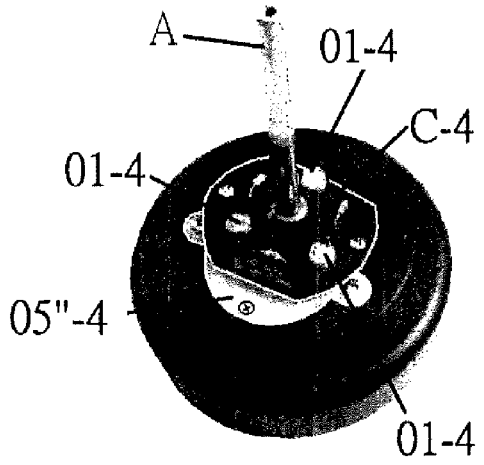
FIGS. 4, 4A, and 4B show the projection light of copending a fourth preferred embodiment that shares with the projection light of U.S. patent application Ser. No. 14/323,318, which a wide area or projection image night light with a motor or spin/rotating kit to move the projected big image.
Figure 4A:
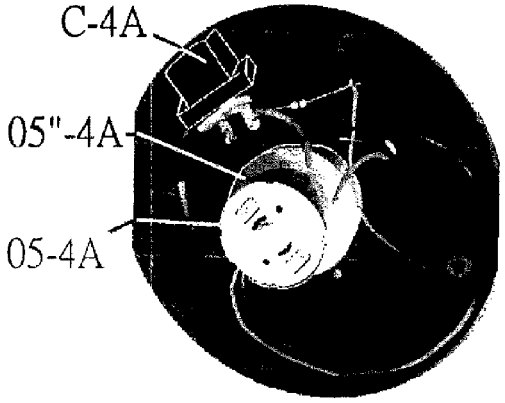
Figure 4B:
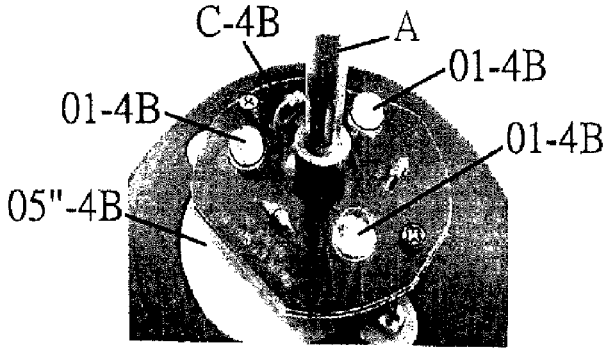

FIGS. 4, 4A, and 4B a moving arrangement corresponding to the ones disclose in U.S. patent application Ser. Nos. 14/323,318 and 14/023,889, including a motor (05-4A) arranged to drive a shaft (A) that rotates a top projection-lens which has multiple refraction and/or reflection lenses to allow light beams from the inner LEDs (01-4) (01-4B) to pass through the multiple reflective and/or refractive lenses and spread out the different color light beams over a wide viewing angle and create a moving projection-image. Each color of the LEDs (01-4) and (01-4B) can be independently turned on and off under control by an IC to provide a variety of light effects such as chasing, random, pair flashing, fade-in and fade out, sequential, color changing, freeze function, auto changing function, seven-in-one function, or any other available function from the marketplace.

The light device of FIGS. 4, 4A, and 4B also has a circuit (C-4) (C-4A) (C-4B) and motor's gear set (05'-4) (05'-4A) (05"-4B) so as to obtain a desired rotating speed of shaft (A) and drive the top multiple reflective and/or refractive dome lens to rotate at a predetermined speed so that people will enjoy the moving and changeable color light effects in an LED night light or LED bulb.

FIG. 5A shows the same construction as FIG. 2, including a moving or rotating optic-lens-assembly (03D) which has six single optic-lenses (03-1) arranged to transform the shaped or tiny-image light beam into a big projection-image displayed on a desired surface. The six single optic-lenses are arranged within a frame (F) over 360 degrees so that each single optic-lens (03-1) almost covers 60 degrees of the frame (F). As a result, the wide viewing angle projection-image will also move around 60 degrees. The LEDs (01-1) have a narrow viewing angle so an optional optic-lens (02-2) may be added to cause the narrow light beam to become a wider viewing angle light beam or to add to the distance from the LED top, although this will result in reduced brightness. When the LED light beams are emitted through the image carrier's (02-1) openings, printed windows, stencils, cutouts, films, slide, display-units or changeable image or display, the shaped or tiny-image light beam will then be emitted through one of the optic-lenses (03-1) fixed on the frame (F) of the projection-lens-assembly (03D), which will widen the viewing angle of the shaped or tiny-image light beam and form an image. Because all the optic-lenses (03-1) are rotating one by one, each single optic-lens image will look like a continuous image moving in a circle from one side to the other side over an angle that depends on how may angles are occupied by each single optic-lens (03-1) in the frame (F).

As shown in FIG. 5A, the image carrier (02-1) has four shaped openings, holes, cutouts, printed windows, films, slides, display-units, or changeable display windows so as to project four different images to create four big projection-images upon rotation of the image carrier.

Also as shown in FIG. 5A the LED (01-1), image carrier (02-1), single or multiple projection lens assembly (03-1) and motor (05A) and gear set (05"-1) are all fixed along the shaft (A) within a desire frame (F) or fixed on housing parts (not shown) so as to be useable with different outside housings in the form of an LED night light or LED bulb with respective prongs or a bulb base to get AC power.

As shown in FIG. 5B, the LED projection light has the same LEDs (01-2), image-carrier (02-2), and projection-lens assembly (03-2) with single optic-lens (03D) as the embodiment of FIG. 5A, but only the projection-lens-assembly rotates with the shaft (A) and a tube or tube assembly is provided to install an optional additional optic-lens to widen the narrow LED light beams and prevent light beam leakage so as to concentrate all LED light beams on the projection-lens assembly, depending on market requirements. The optic-like tube means can be in any shape such as a wider top and narrow end type of optic-like tube or tube-assembly.

FIG. 5C shows an alternative image-carrier in the form of a film or slide which fits into the optic-like tube or tube-assembly, which may be straight or have a wider-top-narrow-base configuration, and which has reflective material coated outside so that no light can leak. The LEDs may also extend into one end of the optic-like tube or tube-assembly and a film or slide installed within the optic-like tube inside by a groove, holder, or ring. A wider or narrower light beam is emitted to a top rotating single optic-lens (03-3) to create multiple rotating big projection images such as STAR WARS™ characters, FROZEN™ characters, or any DISNEY™ characters or cartoons, times, logos, art work. etc.

FIG. 6 shows the three main components including LEDs (01-LED), image carrier (02-ImCa), and projection-lens-assembly (03-PL) to widen a viewing angle of big moving projection image. The LEDs (01-LED) have a top image carrier (02-ImCa) that emits shaped or tiny-image light beams to the projection-lens-assembly (03-PL). Each single projection-lens moves to get a continuously moving clear and big projection-image that travels over a predetermine arc.

The LEDs (01-LED) emit a narrow light beam (N1) as shown on a right hand side of FIG. 6. The narrow light beam (N1) passes through the optional other optic-lens (OP-1) or optics-like tube (OP-1) to become a wider (W2) beam that pass through the image carrier (02-ImCa) with some distance to get an even wider (W3) light beam, which passes to project-lens-assembly (03-PL) to form a continuously moving big project-image (04-MBPI). The more LEDs (01A, 01B, 01C, 01D) and image-carriers (04A), the more moving big project images. The moving big project image (04-MBPI) has a moving direction that is clockwise or counter-clockwise, depending on the motor and gear-set direction. The moving angle of the moving big projection image (04-MBPI) will depend on the number of single optics-lenses (04E) within the 360 degree circumference of the holder or frame. More single optics-lenses (04E) will result in smaller traveling angles of the moving big projection images (04-MBPI). As shown in FIG. 6, six single optic-lenses (04E) are provided within the 360 degree frame or holder, so that the moving big projection-image (04-MBPI) will travel around 360/6=60 degrees. Consequently, more single optic-lenses (o4E) inside of the frame (F) will result in smaller travel angles. Also, the less openings (04B), cutouts (04C), printed windows (04D), film (04B), or slides (04E), the fewer different types, designs, or shapes of moving big project-images. (04-MBPI). Also, if only one top single optic-lens with one printed-window is provided, then there will only be one continuous moving big projection image (04-MBPI), which will move very slowly because the shaft rotates 360 degree and one single optic-lens can project image for around 180 degrees. In summary, as described in more detail above:

FIGS. 1A, 1B, and 1C show three embodiments of a projection night light having a wider viewing angle and moving projection image. The night light of FIG. 1A uses different on-times of multiple LEDs to change the position or orientation of the light source and thereby provide a motion effect. The night light of FIG. 2A uses a motor or a spinning, rotating, or moving device to cause an image carrier(s) and therefore a projected image(s) to move. The night light of FIG. 3A uses a magnet and magnetic coil with mechanical arms to cause the image carrier to move, shake, or swing and move the big projected image. FIG. 1D shows a detailed construction of the night light of FIG. 1B, which has a movement or motor at the bottom and an axle long enough to hold and rotate the image carrier and also allow for LEDs and a circuit board to be positioned along an axis of the night light such that light beams pass through a top optic-lens to change a narrow LED light beam into a wider and parallel light beam after having passed through the image-carrier's opening, cutout, windows, printed window, film, slide, display, or digital data display, the top projection-lens being any type of refraction-lens, multiple refraction-lens, refraction plus reflection lens, or any combination of lenses to create desired light effects.

Figure 1E:
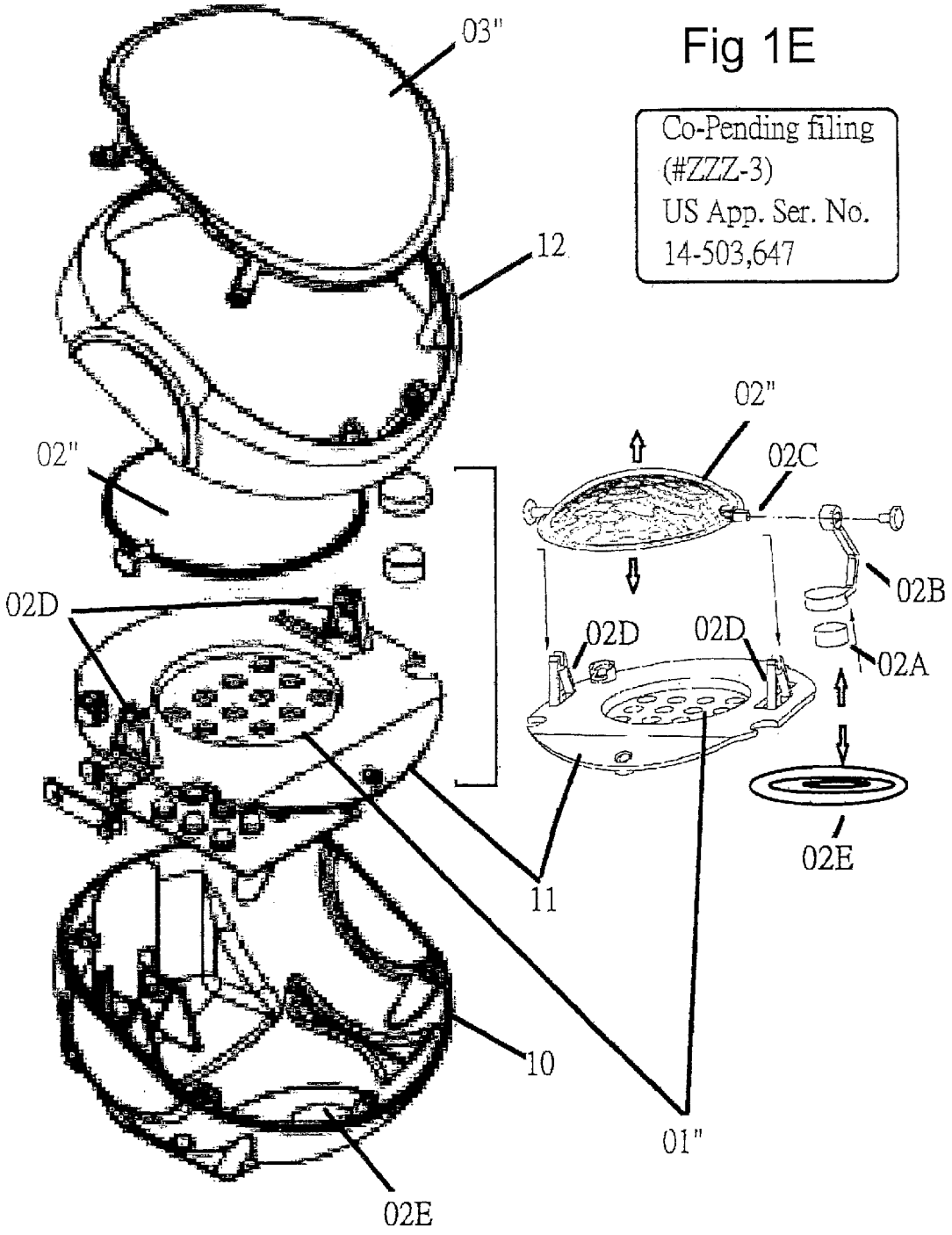
FIG. 1E shows detailed construction of the night light of FIG. 1C, which has a magnet and magnetic coil set to generate a magnetic reaction force that pulls and pushes a swing-arm's built-in magnetic unit so as to move the swing-arms and cause the image-carrier to move back-and-forth, thereby simulating sea wave moving effects. The LED light beams pass through the sea-wave textured image-carrier and emit a tiny image to a top projection-lens, which magnifies and projects the wider viewing angle projection image to desired surfaces including a wall, ceiling, or floor.

FIG. 1E shows detailed construction of the night light of FIG. 1C, which has a magnet and magnetic coil set to generate a magnetic reaction force that pulls and pushes a swing-arm's built-in magnetic unit so as to move the swing-arms and cause the image-carrier to move back-and-forth, thereby simulating sea wave moving effects. The LED light beams pass through the sea-wave textured image-carrier and emit a tiny image to a top projection-lens, which magnifies and projects the wider viewing angle projection image to desired surfaces including a wall, ceiling, or floor.

Figure 3:
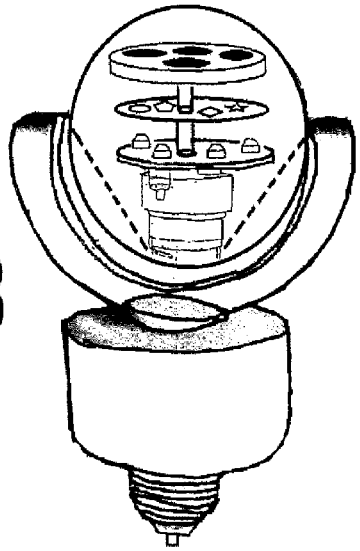
FIGS. 3, 3A, 3B, 3C, 3D, 3E, and 3F show other embodiments of an LED bulb. The LED bulb can be used for downwardly directed lighting, or as in entrance light, stair light, or recess light applications, as shown in FIGS. 3A, 3B, and 3C, or for applications in a ceiling, walls, or lamp shade made of cement, concrete, metal, porcelain, pottery or any material may block, affect, or interfere with electromagnetic wave or signal transmission, as shown in FIGS. 3F, 3E, and 3D, and which have moveable-means such as retractable, extendable, spinning, rotating, or moving arms, a snake housing, or a hinge to move at least one level of the LED bulb away from (a) heat (b) light blocking means, (c) electric signal blocking means, or (d) any other blocking-means that affects a function of the LED bulb.
Figure 3A:
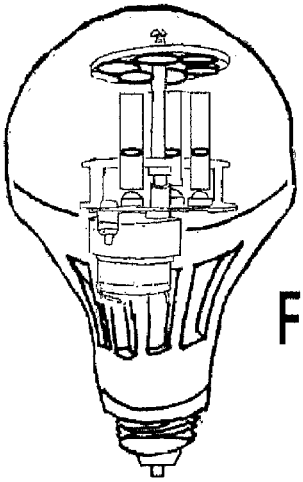
Figure 3B:
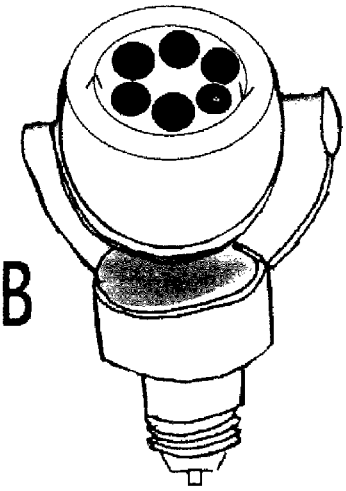
Figure 3C:
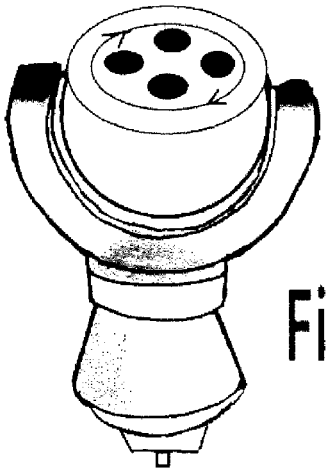
Figure 3D:
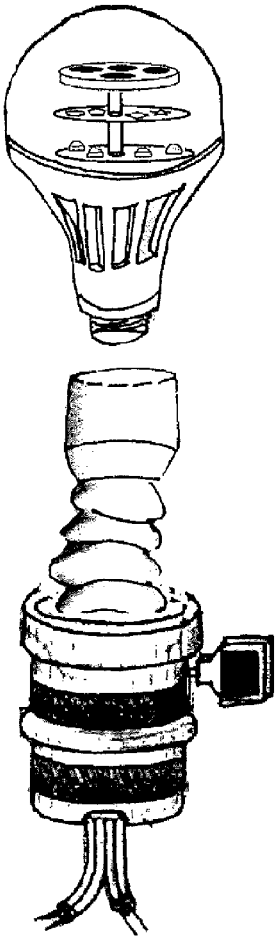
Figure 3E:
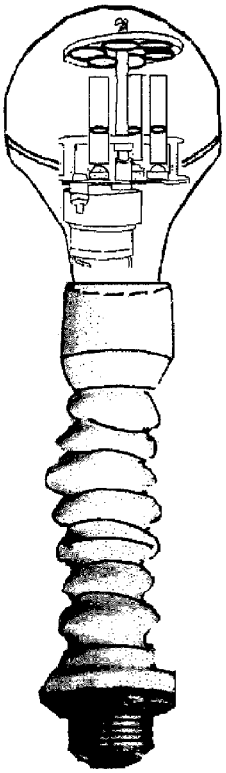
Figure 3F:
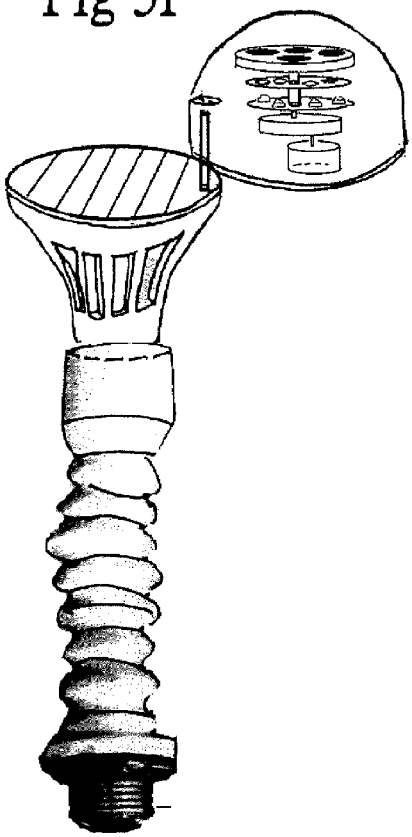

FIGS. 3, 3A, 3B, 3C, 3D, 3E, and 3F show other embodiments of an LED bulb. The LED bulb can be used for downwardly directed lighting, or as in entrance light, stair light, or recess light applications, as shown in FIGS. 3A, 3B, and 3C, or for applications in a ceiling, walls, or lamp shade made of cement, concrete, metal, porcelain, pottery or any material may block, affect, or interfere with electromagnetic wave or signal transmission, as shown in FIGS. 3F, 3E, and 3D, and which have moveable-means such as retractable, extendable, spinning, rotating, or moving arms, a snake housing, or a hinge to move at least one level of the LED bulb away from (a) heat (b) light blocking means, (c) electric signal blocking means, or (d) any other blocking-means that affects a function of the LED bulb.

FIGS. 4, 4A, and 4B show the projection light of copending a fourth preferred embodiment that shares with the projection light of U.S. patent application Ser. No. 14/323,318, which a wide area or projection image night light with a motor or spin/rotating kit to move the projected big image.

FIGS. 5A, 5B, and 5C show a fifth preferred embodiment which can have three main constructions of an LED(s), image carrier(s), and projection-lens assembly with motor/movement means to drive an axle on top of the motor and which has a plurality of LEDs as a light source, the LED light beams passing through the image-carriers, each of which has one or more than one film, slide, openings, printed windows with or without a fixed or rotating holder or disc. The lighted tiny image from the image carrier is emitted through a top projection-lens assembly which may include one or more than one projection-lens arranged to be moved, rotated, or spun to allow the tiny-image light beam to fall within each projection-lens from one edge to another edge to form a big projection image that moves across a ceiling or walls or floor from an angle N to N-1. The angle depends on how many projection-lenses are inside a round disc, carrier, or holder. For example, six lenses may be arranged on the disc as shown in FIG. 5A, so that each projection-lens covers an angle of about 60 degrees, with the moving big projected image also covering the same 60 degree from appearance to disappearance. In this embodiment, all parts fit within the LED bulb housing without a tube or tube-assembly piece.

FIG. 5B shows an alternative arrangement of a rotating multiple projection-lens assembly which has a round holder to hold or fix six projection-lenses each extending over an angle of around 60 degree or less so that the big projected image will move from appearance to disappearance over a 60 degree angle on a surface. The difference between the LED bulb of this embodiment and that of FIG. 5A is that the light beams from the LED(s) pass through a separate tube(s), so that the light beams from the two sections will not leak too much to inside the housing.

FIG. 6 illustrates the light theory of a projection assembly with than one projection head, such as the built-in multiple projection-assembly shown in the inventor's U.S. Pat. No. 8,083,377. The current invention has a plurality of the LEDs above which is an image-carrier in one piece or which has many different films, slides, openings, printed windows, or stencils to allow the LED light beams to pass through and form a lighted tiny-image to go through any number N of top projection-lenses in a disc or holder so that a moving big projected image moves over an angle N from appearance to disappearance.

The current invention shares many features with the light devices described in the inventor's copending applications, and may include additional features described in those applications but not specifically mentioned herein.

The invention claimed is:

1. A moving projection-image assembly for a plug-in night light or LED bulb, comprising:

at least one LED;

at least one image-carrier;

at least one projection-lens for projecting an image formed when light beams from the at least one LED pass through the image carrier, the at least one projection-lens increasing a viewing angle of the image as it projects an enlarged image to a surface situated at least an arm's length away from the moving projection-image assembly, wherein the at least one LED, image-carrier, and projection-lens fit within or are supported by one of a frame, support, and housing parts, said frame, support, and housing parts arranged to fit within a plug-in night light or LED bulb; and at least one moving device for causing the projected enlarged image to appear to move, the at least one moving device including at least one of:

(a) a controller for turning multiple LEDs on and off at different times to cause the apparent motion of the projected image;

(b) a motor or time movement for causing movement of the at least one image-carrier or the at least one projection-lens to cause the apparent motion of the projected enlarged image; and (c) a magnetic-unit and magnetic coil set for causing the movement of the at least one image-carrier or the at least one projection-lens to cause the apparent motion of the projected enlarged image.

2. A moving projection-image assembly as claimed in claim 1, wherein the image carrier includes at least one printed window, film, slide, opening, cut-out, stencil, or display-unit that forms a relatively small image as light beams from the at least one LED pass through the image-carrier, the relatively small image being enlarged by the at least one projection-lens.

3. A moving projection-image assembly as claimed in claim 1, wherein the moving projection-image assembly is arranged to fit within an LED plug-in night light.

4. A moving projection-image assembly as claimed in claim 1, wherein the moving projection-image assembly is arranged to fit within an LED bulb.

5. A moving projection-image assembly as claimed in claim 1, wherein the motor is coupled to a gear set to reduce a high motor speed to a relatively low shaft speed for rotating the at least one image-carrier or the at least one projection-lens.

6. A moving projection-image assembly as claimed in claim 1, wherein the at least one projection-lens is included in a projection-lens assembly rotated by the motor or movement at a predetermined speed.

7. A moving projection-image assembly as claimed in claim 1, wherein the at least one LED includes a plurality of LEDs or at least one LED arranged to emit light in a plurality of colors.

8. A moving projection-image assembly as claimed in claim 1, wherein the at least one projection-lens is a single projection-lens mounted in a frame, holder, or disc.

9. A moving projection-image assembly as claimed in claim 1, wherein the at least one projection-lens includes a plurality of projection-lenses having different optical properties.

10. A moving projection-image assembly as claimed in claim 1, wherein said moving device causes said at least one projection-lens or said at least one image-carrier to undergo at least one of the following motions: rotation, spinning, vibrating, shaking, and waving.

11. A moving projection-image assembly as claimed in claim 1, wherein said controller creates said apparent motion of the projected image by causing the plurality of LEDs to sequentially flash, fade-in and fade-out, change colors, randomly turn on and off, or exhibit other LED light performances, effects, duration, or duty cycles.

12. A moving projection-image assembly as claimed in claim 1, further comprising another optics-lens having a surface texture or printing.

13. A moving projection-image assembly as claimed in claim 1, wherein said projection-image assembly includes a tube or tube assembly having a narrow base and a relatively wider top to increase an area of light exiting the tube or tube assembly.

14. A moving projection-image assembly as claimed in claim 1, wherein the projected image is one of a cartoon character, time, geometrically shaped image, logo, word, artwork, weather display, or vision image.

15. A moving projection-image assembly as claimed in claim 1, wherein the at least one projection-lens is included in a rotating assembly that causes the projected image to move along an arc from one side of a circle to the another side.

16. A moving projection-image assembly as claimed in claim 1, wherein the at least one LED includes color-changing LEDs, the image-carrier is a rotating image-carrier having shaped openings, cutouts, or printed windows, and the projection-lens assembly includes multiple projection-lenses to widen the projected image.

17. A moving projection-image assembly as claimed in claim 1, wherein said controller creates said apparent motion of the projected image by causing the plurality of LEDs to turn on and off at different times, and light beams from the LEDs are caused to pass through a first optic-lens having a textured surface, and the at least one projection-lens is a second optics-lens having a relatively large size to transmit light beams that have been dispersed by the textured surface of the first optic-lens.

18. A moving projection-image assembly as claimed in claim 1, wherein the at least one image-carrier is a moving image carrier having a plurality of printed windows, cutouts, stencils, films, or slides, and the at least one projection-lens is a relatively large size flat projection-lens.

19. A moving projection-image assembly as claimed in claim 1, further comprising an outer cover or outer projection-lens having a rounds, semi-spherical, or spherical shape to further enlarge the projected image.

20. A moving projection-image assembly as claimed in claim 1, further comprising an additional optic-lens situated in front of the at least one LED for widening a narrow light beam emitted by the at least one LED before it passes through the at least one image-carrier and at least one projection-lens.

* * * * *